US007618305B2

(12) United States Patent
Gut et al.

(10) Patent No.: US 7,618,305 B2
(45) Date of Patent: Nov. 17, 2009

(54) APPARATUS AND METHOD FOR COMFORTABLY AND DYNAMICALLY ADJUSTING THE GIRTH OF A GARMENT FASTENED BY HOOK AND EYE

(75) Inventors: Mary Gut, Raleigh, NC (US); Erik Matheny, Raleigh, NC (US)

(73) Assignee: Ideal Fastener Corporation, Oxford, NC (US)

( * ) Notice: Subject to any disclaimer, the term of this patent is extended or adjusted under 35 U.S.C. 154(b) by 0 days.

(21) Appl. No.: 11/925,392

(22) Filed: Oct. 26, 2007

(65) Prior Publication Data

US 2008/0214090 A1 Sep. 4, 2008

Related U.S. Application Data

(60) Provisional application No. 60/892,730, filed on Mar. 2, 2007.

(51) Int. Cl.
*A41B 3/00* (2006.01)

(52) U.S. Cl. ..... 450/72; 450/13; 24/697.1; 24/DIG. 49; 24/DIG. 43

(58) Field of Classification Search ..... 450/1, 450/13, 14, 17, 18, 25, 26, 28, 35, 72, 73, 450/79, 80, 82, 135, 136, 142; 2/96, 251, 2/252, 257, 259, 263, 264, 336, 338; 24/697.1, 24/697.2, 592.1, DIG. 43, DIG. 49
See application file for complete search history.

(56) References Cited

U.S. PATENT DOCUMENTS 6,520,832 B2 * 2/2003 Devita et al. ..... 450/1
6,837,771 B2 1/2005 Falla

* cited by examiner

*Primary Examiner*—Gloria Hale
(74) *Attorney, Agent, or Firm*—The Marbury Law Group PLLC

(57) ABSTRACT

The present invention is drawn to a hook and eye closure for garments such as brassieres. The eye tape and/or the hook tape is formed of laminated elastically elongatable layers, and can incorporate a cushioning layer to provide a comfortable and self-adjusting fit to garments. The lamination of the elastically elongatable layers allows manufacturing on existing equipment and helps provide smooth, soft edges, particularly when ultrasonically cut.

24 Claims, 6 Drawing Sheets

APPARATUS AND METHOD FOR COMFORTABLY AND DYNAMICALLY ADJUSTING THE GIRTH OF A GARMENT FASTENED BY HOOK AND EYE

RELATED APPLICATIONS

This application claims the benefit of U.S. Provisional Application No. 60/892,730, filed Mar. 2, 2007, which is hereby incorporated by reference.

FIELD OF THE INVENTION

The present invention relates to garments that are fastened with a plurality of hook and eye pairs. More specifically the present invention comprises elastically elongatable hook or eye tape with improved wear and comfort characteristics that is useful for brassieres and will dynamically adjust the girth of the garment to conform to the needs and movements of the wearer.

BACKGROUND

Garments such as brassieres have used hook and eye fasteners for more than ninety years. The hooks and eyes are mounted on a stabilized (non-stretchable) fabric, usually referred to as a "tape." The tape is then mounted on the garment. Typically, a set of vertical columns and rows of eyes, usually between two and four in number, are aligned on a tape. Similarly there is a tape containing one corresponding vertical column of hooks such that the number of eyes per each column corresponds to the number of hooks. If there are three hooks in the hook column, there will be three eyes in each vertical column of eyes.

The use of multiple, horizontally-spaced columns of eyes allows for minor horizontal adjustment to the garment's fit. Typically, multiple eye columns are separated by about five eighths of an inch, or approximately 16 millimeters on a portion of the stabilized fabric eye tape. In such a case, if there were three columns of eyes mounted on the tape, the wearer would have and adjustment range of five eighths to one and a quarter of an inch (16 to 32 millimeters). If the brassiere is of an incorrect size, discomfort and poor fit are experienced. Studies show that 30% of women buy brassieres of a size too small. Often the brassiere size requirements change over time or even during the day. Multiple columns of eyes provide for some relief, but the wearer is limited to a few fixed positions. Additionally, when the hook row gets inserted into an eye row, the back of the hook can often be felt through the fabric of the eye tape by the wearer due to the pressure of the closure. Furthermore, the back of the bra where the tapes are attached has a tendency to ride up on the wearer's back, requiring the wearer to re-adjust the garment.

Adjustment capabilities greater than that provided by multiple eye columns was desired. Further, it was desirable to have a garment automatically adjust (expand and contract) without intervention by the wearer. A prior attempt to address this adjustment issue is disclosed in commonly-owned U.S. Pat. No. 6,520,832. While the decreased tension in the garment due to the horizontal flexibility lessened the pressure of the hook as it pressed against the wearer, it did not totally eliminate the discomfort. Additionally, the present inventors have found that the flexible knitted fabrics used to achieve the girth adjustment as disclosed in commonly-owned U.S. Pat. No. 6,520,832 caused other problems. When manufactured with ordinary sewing techniques, the edges of the flexible knitted fabrics tended to fray, causing premature wear of the edges of the hook and eye tape and discomfort to the user. When the edges of the tape were heat sealed to prevent fraying, the heat sealed edges were uncomfortably hard/sharp and would later crack when stretched, making audible cracking noises. Again, this cracking caused premature wear of the edges of the hook and eye tape and discomfort to the user. Further, the uni-directional stretch tape of U.S. Pat. No. 6,520,832 had sufficient vertical rigidity in the hook and eye tapes to cause the tapes to shift vertically out of place when the wearer moved, requiring the wearer to adjust the garment.

What would be desirable is an apparatus and method for dynamically adjusting the girth of a garment fasted by hook and eye that has markedly increased comfort to the wearer and improved durability.

BRIEF SUMMARY OF THE INVENTION

The present invention incorporates a laminated base tape for a hook and eye closure that provides for dynamic adjustment of the girth of a garment by using an elastically elongatable fabric that has been laminated to at least one additional elastically elongatable layer. The glue or adhesive used for the lamination of the layers effectively prevents unacceptable fraying of the edges of the elastically elongatable fabric and, when an additional elastically elongatable layer on the eye tape is formed from a elastically elongatable cushioning material such as stretchable foam, discomfort due to pressure of the hook pressing against the user can be substantially eliminated. The laminated base tape allows for a smooth, comfortable, and durable edge, whether ultrasonically sealed and cut, laser cut, scissor/blade cut, or die cut. Omni-directional elastic elongation of the base tape allows the base tape to move with the wearer to remain comfortably in place.

It is an aspect of the invention to provide flexibility to garment size without the wearer having to make a manual adjustment by use of an elastically elongatable, laminated base tape in a hook and eye closure of the garment.

It is a further aspect of the invention to provide size flexibility to a brassiere without the wearer having to make an adjustment by use of an elastically elongatable, laminated base tape in a hook and eye closure of the brassiere.

It is an aspect of the invention to provide a garment or brassiere that moves with the wearer through use of an elastically elongatable, laminated base tape in a hook and eye closure.

It is another aspect of the invention to provide a smooth, comfortable edge to a hook and eye closure through use of an elastically elongatable, laminated base tape.

It is another aspect of the invention to provide flexibility to a garment size with improved wearer comfort through use of an elastically elongatable cushioning layer on the eye tape of a hook and eye closure of the garment.

It is another aspect of the invention to provide flexibility to a brassiere size in a horizontal dimension with improved wearer comfort through use of an elastically elongatable cushioning layer on the eye tape of a hook and eye closure of the brassiere.

It is yet another aspect of the invention to provide an elastically elongatable eye tape for a hook and eye closure with cushioning for improved comfort.

DETAILED DESCRIPTION OF THE INVENTION

As previously disclosed in commonly-owned U.S. Pat. No. 6,520,832, although the addition of flexibility to a hook and eye closure, such as used in a brassiere, may appear simple, a workable solution for use in a brassiere is by no means trivial. Proper manufacture of a hook and eye closure for a brassiere was believed to depend on stability of the hook and eye tape used so as to assure proper alignment of the fastener during sewing operations on conventional machinery. Mere substitution of the stabilized tape material with single or multiple plies of stretchable material resulted in unacceptable misalignment of the fasteners.

In an attempt to solve these problems, the inventor in commonly-owned U.S. Pat. No. 6,520,832 selected a material for the tape that stretched in only one direction so as to enable elastic horizontal elongation while maintaining vertical stability to allow for proper alignment of hooks and eyes during sewing operations with existing production machinery. However, these unidirectional elongatable base tapes suffered from problems with fraying of blade-cut edges and uncomfortably sharp heat-sealed edges.

Upon further investigation by the present inventors, it has been found that substitution of the stabilized tape material with a stretchable material does not result in unacceptable misalignment of the fasteners if the stretchable material is formed of laminated layers of elastically elongatable material. Additionally, use of omni-directional elastically elongatable material increases user comfort by moving better with the wearer. Furthermore, the lamination of the elastically elongatable layers prevents fraying of blade-cut edges and forms comfortably smooth heat-sealed and/or ultrasonically-cut edges.

Embodiments of the present invention provide flexibility to a hook and eye closure, such as used in a brassiere, by forming a base tape of a hook and eye closure from a first elastically elongatable fabric layer laminated to at least one additional elastically elongatable layer. The elastically elongatable fabric layer will typically be formed of a knitted fabric with elastic fibers, such as DuPont Lycra®. The at least one additional flexible layer can be formed of a knitted fabric with elastic fibers, a stretchable foam, or a rubber-based product. In some embodiments, the base tape will include more than one additional elastically elongatable layer. The elastically elongatable layers are laminated to one another using a suitably flexible glue or adhesive so as to form laminated packages. While it is possible to use elastically elongatable layers with unidirectional stretch in the horizontal direction, the present invention does not require this property, and preferably uses elastically elongatable layers that stretch in various directions (e.g., omni-directional stretch) for improved wearer comfort.

Figure 1A:
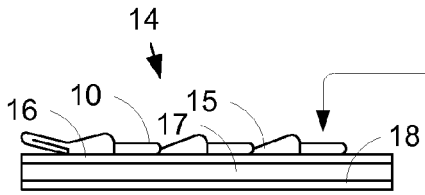
FIG. 1A illustrates an edge view of eye tape in an arrangement usable for the present invention.

FIG. 1A illustrates an edge view of the eye tape in an embodiment that uses three columns of eyes 10 spaced in an equidistant manner on an elastically elongatable base tape. The elastically elongatable base tape 14 typically includes an elastically elongatable fabric cover strip 15 that cosmetically conceals where the hardware is sewn or otherwise attached to the base tape. Typically the eyes 10 and hooks 20 are attached to the base tape with a pair of loops that are sewn to the base tape. The cover strip 15 illustrated in FIG. 1A is a conventional folded-type design, but is formed from thin, elastically elongatable fabric, although other arrangements are also possible without departing from the scope of the invention. In one embodiment, the cover strip 15 of tape 14 can be sewn and laminated with glue, both to itself where folded, and to the base tape on a lower surface. In another embodiment, the cover strip can be sewn to the base tape and secured at the edges to the laminated base tape by ultrasonic sealing and cutting. In a further embodiment, the cover strip can be sewn to the base tape and is formed from a stretch fabric that does not tend to fray.

Figure 5A:
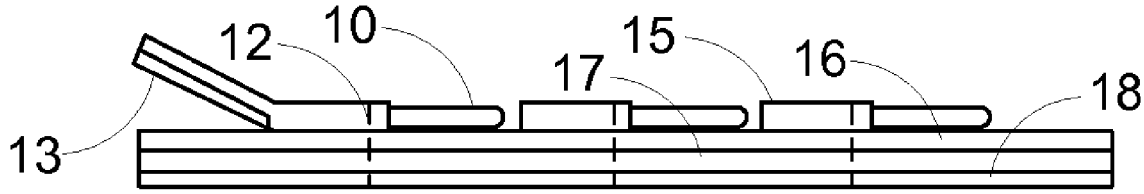
FIGS. 5A-5B illustrate an edge and front view of an alternative embodiment of an eye tape in accordance with the present invention.
Figure 5B:
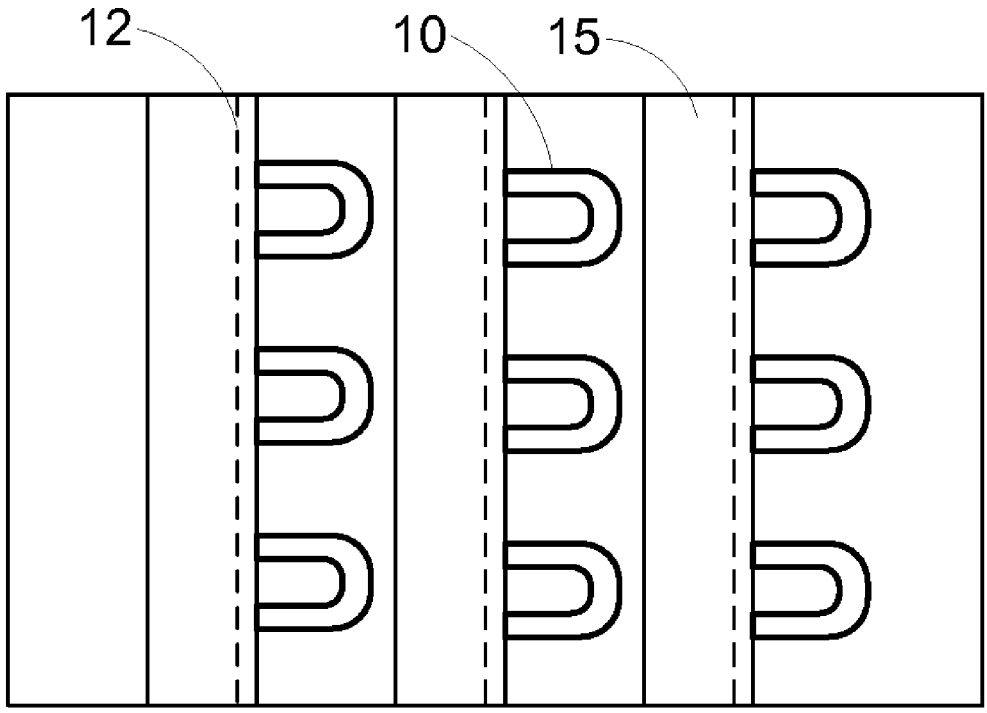

In another embodiment, illustrated in FIGS. 5A and 5B, the cover strip is formed from a plurality of individual elastically elongatable fabric cover strips 15 that are sewn, either with thread or ultrasonically, to the base tape at 12 and then laminated thereto with suitable glue or adhesive. As the cover strips and glue add some strength to the overall laminated package, it is preferable in some cases to minimize the amount of material in order to retain as much elongation as possible in the base tape. Alternately, the individual cover strips could be sewn at both longitudinal edges. While the cover strip is preferred for cosmetic reasons, it is not critical to practice of the invention and is not meant as a limitation.

Figure 1B:
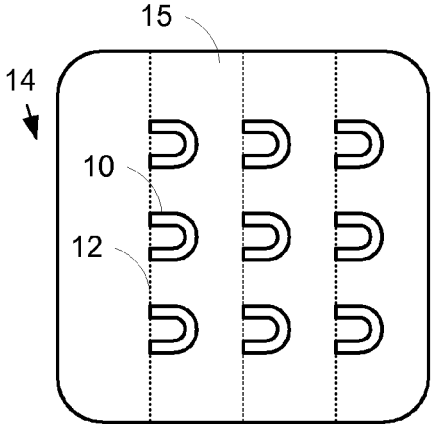
FIG. 1B illustrates the front view of the eye tape of FIG. 1A, comprising three columns and three rows of eye hardware.
Figure 1C:
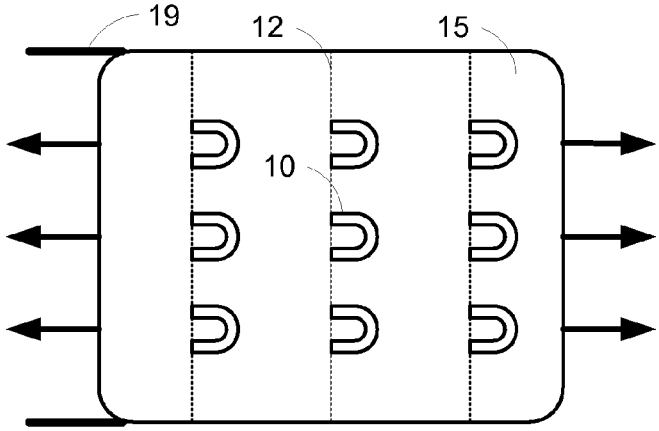
FIG. 1C illustrates the front view of the eye tape of FIG. 1B in a stretched position.
Figure 1D:
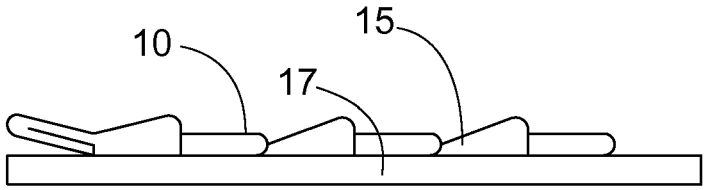
FIG. 1D illustrates an edge view of an alternative embodiment of the eye tape using a stretchable foam base tape.

The elastically elongatable base tape 14 illustrated in FIGS. 1A and 1B is formed from an elastically elongatable fabric layer 16 laminated with suitable adhesive to at lease one elastically elongatable layer 17, 18. In the illustrated embodiment, layer 17 is a stretchable foam or other elastically elongatable cushioning material and layer 18 is an elastically elongatable fabric layer. Only one of the layers is needed for practice of the invention. Indeed, as improvements are made to stretchable foam, it may even be possible to form the base tape solely from stretchable foam 17, as illustrated in FIG. 1D.

Figure 2A:
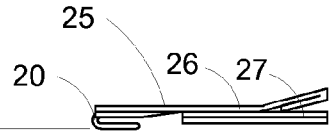
FIG. 2A illustrates an edge view of a hook portion for engaging the eyes in FIG. 1A.

As illustrated by the arrow between FIG. 1A and FIG. 2A, an edge-view of a corresponding hook tape is illustrated in FIG. 2A, wherein one row of hooks 20 are mounted on an elastically elongatable base tape. While the present invention can be practiced with only one of the base tapes (i.e., either the eye base tape or the hook base tape) being elastically elongatable, both base tapes are illustrated as elongatable in FIGS. 1A and 2A. In a preferred embodiment, only the eye tape is elastically elongatable. The outer portions of both the eye tape and the hook tape preferably include lips or openings (Y-shaped in the edge view) for attachment to a garment, such as by sewing or ultrasonic bonding. As illustrated, the upper fabric layers of tapes 15 and 25 are folded and laminated at the outer portions to prevent fraying, but this is not meant as a limitation since these portions could also be laminated or ultrasonically bonded to the garment to prevent possible fraying (and if the garment is stabilized, the ends will not be as subject to the stretching forces that give rise to the unraveling at the edges). In certain embodiments, a portion of stabilized fabric, such as nylon tricot, can be laminated on the inside of the lip to facilitate attachment to a garment, such as the back of a brassiere. In this manner, the visible portion retains the aesthetics of the other portions of the base tape, yet the lip retains the attachment properties of prior art stabilized tapes.

The base tape on the hook side further includes laminated, elastically elongatable layers 26 and 27, although only one of these is needed for practice of the invention on the hook-side base tape. While layers 26 or 27 could be made of stretchable foam, the primary purpose of the stretchable foam is to provide cushioning between the hook and the wearer. Since layers 26 and 27 are not positioned between the hook and the wearer, use of cushioning material is not critical for these layers, which will typically be formed of elastically elongatable fabric or rubber. Additionally, where a rubber layer is used, an additional elastically elongatable fabric layer is preferably laminated to the lower side so as a soft backing material to place fabric next to the skin of the wearer, which is typically more comfortable and tactilely pleasing than rubber.

Figure 2B:
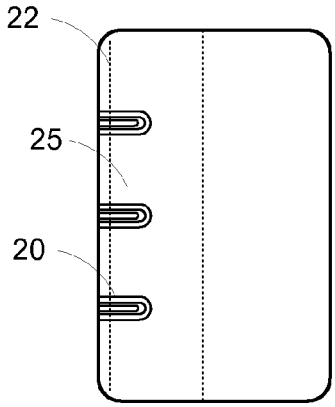
FIG. 2B illustrates the back view of the hook tape for engaging the eye tape of FIG. 1B, comprising a single column and three rows of hook hardware.
Figure 2C:
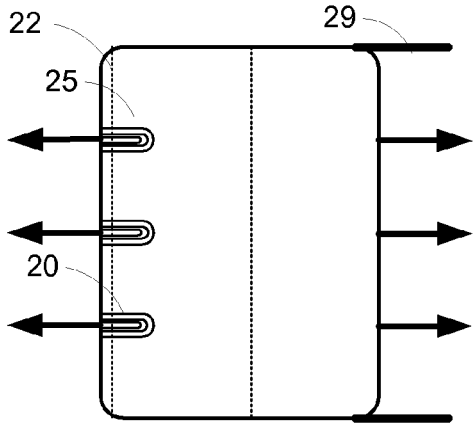
FIG. 2C illustrates the back view of the hook tape of FIG. 2B in a stretched position.
Figure 4:
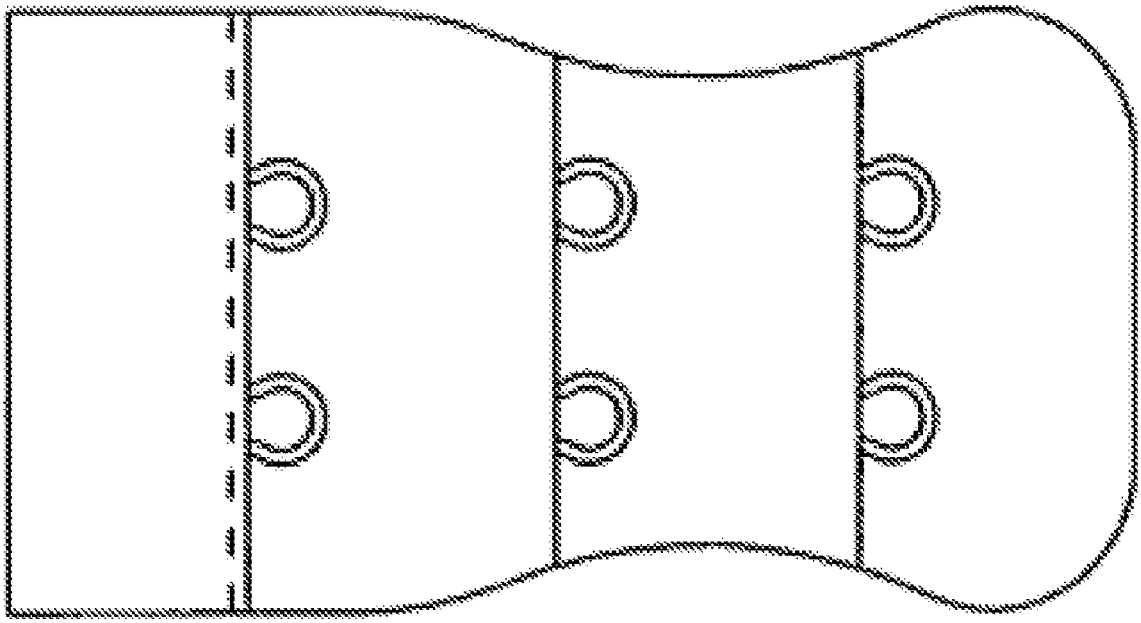
FIG. 4 illustrates a front view of an alternatively-shaped embodiment of an eye tape in accordance with the present invention.

FIG. 1B illustrates a front view of the eye tape from FIG. 1A, showing three eyes 10 in each column, again spaced in an equidistant manner on the elastically elongatable tape 15 and sewn in position in the usual manner resulting in seams 12. The corresponding back-view of the hook tape from FIG. 2A is illustrated in FIG. 2B, wherein the column has three corresponding hooks 20 mounted on elastically elongatable tape 25 in the usual manner resulting in seams 22. While illustrated as generally rectangular with contoured corners, this is not meant as a limitation. Indeed, the base tapes do not require radiused corners and can employ other shapes, such as trapezoids, hourglass shapes, butterfly shapes, etc., as illustrated in FIG. 4, without departing from the scope of the invention FIGS. 1C and 2C illustrate the respective eye tape and hook tape of FIGS. 1B and 2B in the stretched position, such as when attached to corresponding girth portions of a garment such as brassiere sections 19 and 29, respectively. The illustrated dimensions are not to scale and are not meant to be a limitation, but are disclosed to demonstrate the elastically elongatable nature of the eye tape or hook tape.

In use, either one of the eye tape and hook tape or both can be fabricated in this manner. When the eye tape is elastic, a stable hook tape with one column of hooks can be used. When the hook tape is stretchable, it is preferable to provide an extended elastically elongatable tape portion so as to provide for adequate elongation, as shown between the seams in FIG. 2C.

The typical elongation for use in a brassiere will be between 10-50% with 20-30% being a preferred range, although this is not meant as a limitation. Of course, other applications can have different requirements and preferred ranges.

A suitable, elastically-elongatable material is nylon fabric with elastic fibers such as spandex in a proportion needed to provide the desired elongation in the horizontal direction. Varying the cross section of the base tape can be used to vary the elongation properties. For example, if a trapezoidal base tape is used, with the large end abutting the garment, the tape will have less elongation when worn in a "tight" position, which is acceptable since the wearer can use the other eye hooks to loosen the fit. However, when worn in the "loose" position, the tape will allow additional elongation due to the smaller cross-section of the base tape at that end. This is desirable since the wearer does not have the option of loosening the garment further when worn in this position.

Figure 3:
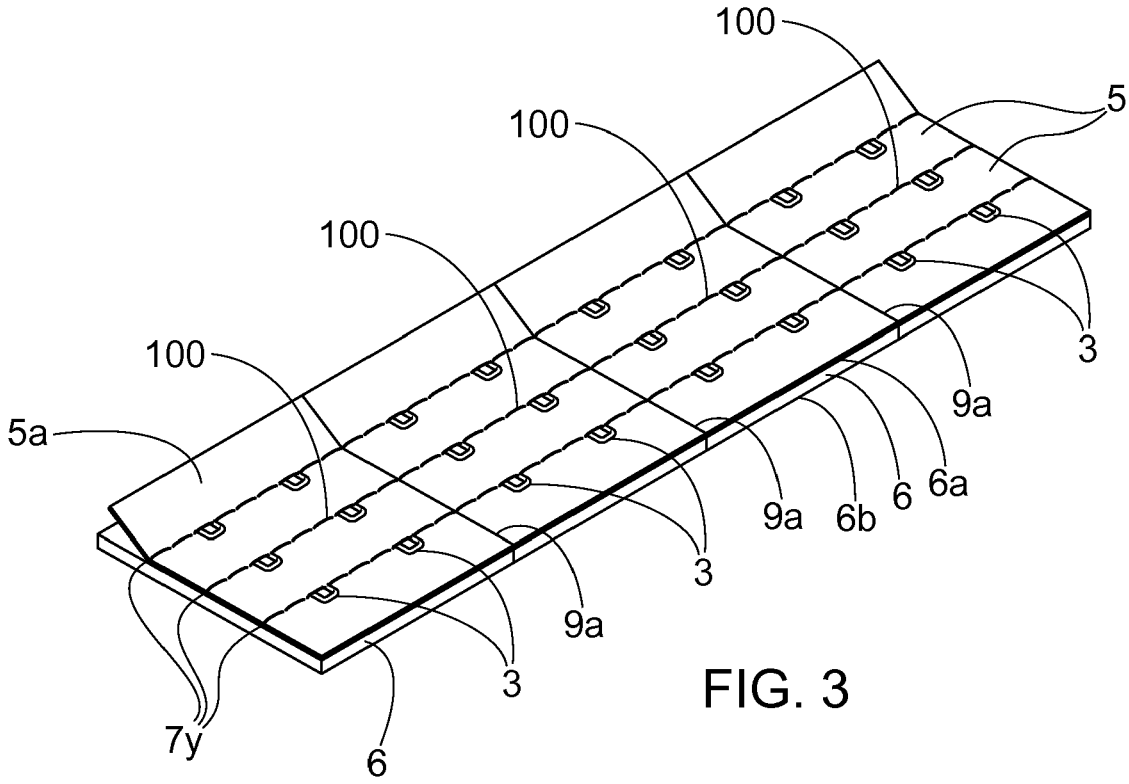
FIG. 3 illustrates an uncut eye tape in accordance with an embodiment of the present invention.

FIG. 3 illustrates a perspective view of several eye closure components 100 connected together in a production stage prior to their separation in accordance with an embodiment of the present invention. The production process also includes connection of all parts of the eye closure components 100 in large strips from which the individual eye closure components 100 are cut into suitable sizes.

FIG. 3 also shows a side view of sewing lines 7*y* connecting metal eyes 3, top elastically elongatable fabric 5, additional elastically elongatable fabric 6*a* laminated thereto, an elastically elongatable cushioning layer 6 (such as stretchable foam, flex foam or rubber) laminated thereto, bottom elastically elongatable fabric 6*b* laminated thereto, and lines 9*a* marking the suitable place for cutting, which can be done using any suitable means. The illustration also shows open lip 5*a* used for attachment to a garment. The resulting product is comfortable, stretchable, dyeable, and printable on the back to eliminate the need for a separate tag.

The process to manufacture the item as shown in FIG. 3 can use standard eye tape manufacturing equipment and can be made in widths from 57 mm wide to 76 mm wide. This eye tape, with the exception of the hardware and sewing thread, is made with 100% elastically elongatable material, which gives the finished eye tape its horizontal stretch. Suitable means for cutting the base tape include ultrasonic sealing and cutting, laser cutting, and scissor/blade/die ("cold") cutting. In each case, the laminated elastically elongatable materials of the base tape help form a soft, comfortable edge that does not fray.

Figure 6A:
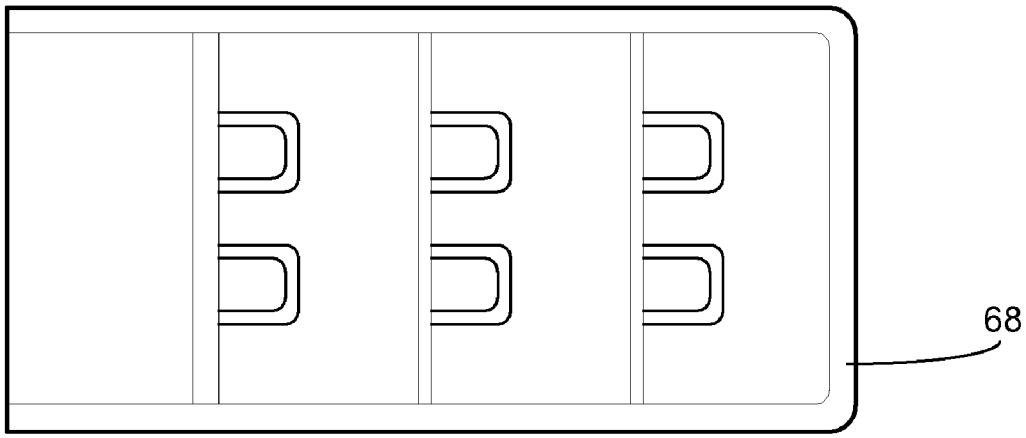
FIGS. 6A-6B illustrate a front and back view of an alternative embodiment of an eye tape in accordance with the present invention.
Figure 6B:
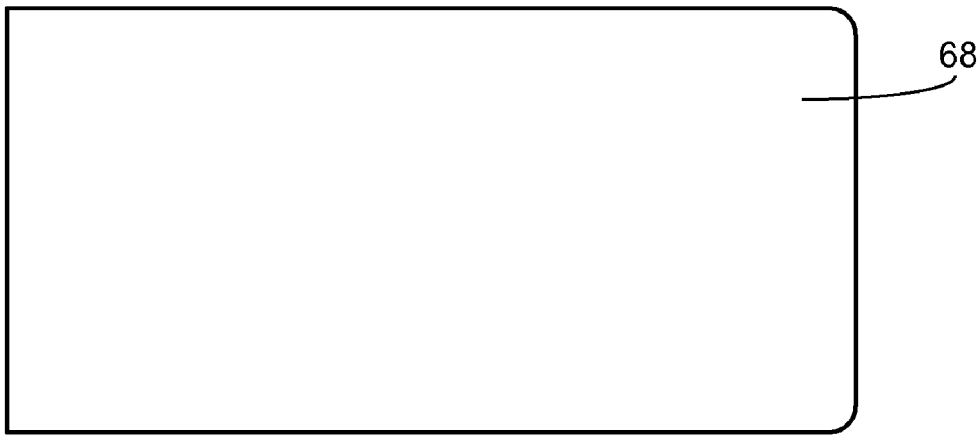
Figure 7:
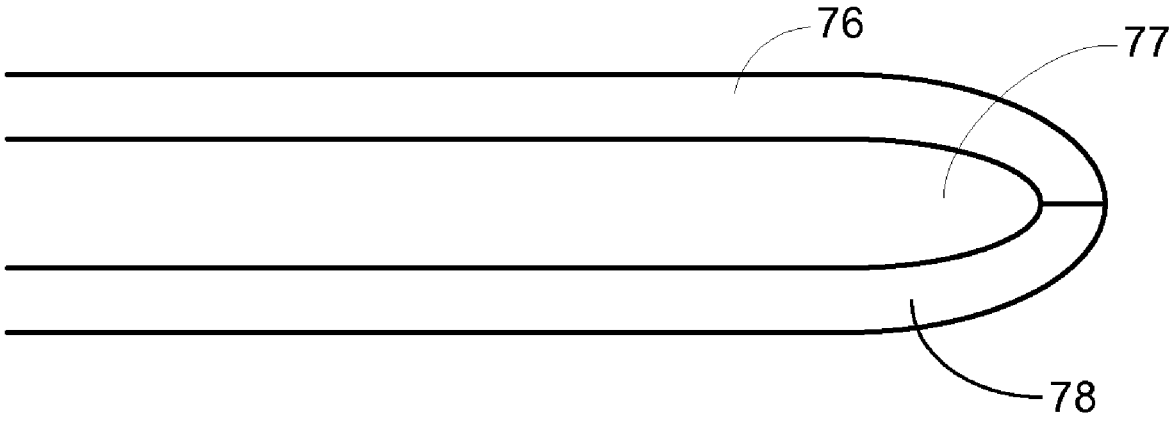
FIG. 7 illustrates a cross section of an exemplary smooth edge formed by ultrasonic cutting of laminated elastically elongatable layers of the present invention.

In a preferred embodiment, the comfort and aesthetics of the base tape are improved by the addition of an elastically elongatable back cover layer 68, as illustrated in FIGS. 6A-6B, using an inverted seal method in accordance with U.S. Pat. No. 6,820,312, so as to form ultra-soft edges. More generally, as illustrated in FIG. 7, the ultrasonic sealing and cutting of the laminated layers (e.g., layers 76, 77, 78) results in acceptably soft and rounded edges.

In use with a brassiere, the hook tape is attached to one of two back sections of the brassiere. In this embodiment, the hooks are facing inward toward the opposite side of the brassiere to interface with the eyes opposite thereto. The tapes vertical axis is aligned with the back sections' vertical edge. The eye tape is attached to the brassiere's other back section, facing outward such that the eyes and hooks align and face each other. The wearer fastens the brassiere by inserting each hook into each eye of a corresponding column. Some adjustment will be achieved when the wearer selects the column to use when fastening. If the inboard column of eyes is used, then the minimum horizontal brassiere size will be achieved. If the outboard column of eyes is used, then the maximum horizontal brassiere size will be achieved.

In the event that the brassiere is still too small, the elastically elongatable tape holding eyes (or the hooks, or both) will stretch. The elastically elongatable material has the ability to recover back to its original dimensions and shape. While the closure of the present invention can provide virtually any desirable amount of elongation, the practical limits are about 10% to 100% elongation, although this is not meant as a limitation. In most embodiments, about 20% to 30% elongation should be sufficient to provide measurable comfort to the wearer.

While discussed herein for use in a brassiere, the invention has utility for other garments, including, but not limited to, body slimmers, corsets, trusses, lingerie, bikini tops, and halter tops.

As used herein, the term hardware used in reference with hook and eye closures refers to the discrete, rigid hooks and eyes, which can be made of metal, plastic, and combinations thereof. The terms sewing and sewn, as used herein, refer to any suitable attachment process, including, but not limited to, using thread, using adhesives, and using ultrasonic fabric sealing methods commonly known as ultrasonic sewing. The term base tape, as used herein, refers to garment portions to which hook and eye hardware are attached. While disclosed herein as being sewn or bonded to a garment, base tape can also be formed integral with the garment.

A first embodiment is drawn to a base tape for a hook and eye closure to allow dynamic girth adjustment of a garment, comprising: a first elastically elongatable fabric layer; at least one additional elastically elongatable layer laminated with adhesive to the first elastically elongatable fabric layer to form an elastically elongatable base tape; and hook or eye closure hardware sewn to the elastically elongatable base tape. This embodiment is not limited to these elements and can include additional structure.

Variations on this first embodiment include: those wherein the at least one additional elastically elongatable layer comprises a second elastically elongatable layer consisting of cushioning material and a third elastically elongatable layer consisting of fabric that is laminated to the second elastically elongatable layer, wherein the cushioning material can be selected from the group consisting of fabric, stretchable foam, flex foam, and rubber; those wherein the closure hardware consists of a plurality of spaced eyes; those wherein the closure hardware comprises at least one hook; those further comprising an elastically elongatable cover strip fabric attached to the elastically elongatable base tape to conceal attachment points of the closure hardware; and those wherein the garment consists of a brassiere.

A second embodiment is drawn to a hook and eye closure for allowing dynamic girth adjustment of a garment, comprising: an eye tape, said eye tape comprising: an elastically elongatable base fabric that elongates elastically in a first direction; at least one additional elastically elongatable layer laminated to the base fabric to form a laminated base tape; at least one eye column positioned on said laminated base tape wherein said at least one eye column extends in a second direction perpendicular to the first direction; and at least one eye row in said at least one eye column, each row containing an eye secured to said laminated base tape; a hook tape, said hook tape comprising: a hook base tape; one hook column positioned on said hook base tape in said second direction; and at least one hook row in said at least one hook column, each row containing a hook secured to said hook base tape.

Variations on this embodiment include: those further comprising: a plurality of parallel eye columns spaced apart from each other in said first direction, a plurality of eye rows in each eye column spaced apart from each other in said second direction, and a plurality of hook rows in said one hook column spaced apart from each other in said second direction and corresponding in number to said plurality of eye rows; those wherein said hook base tape is stabilized; those wherein said hook base tape further comprises an elastically elongatable base fabric that elongates elastically in a first direction, and at least one additional elastically elongatable layer laminated to the base fabric to form a laminated base tape; those wherein said closure allows between about 10% and about 100% elongation; those wherein said closure allows between about 20% and about 30% elongation; those wherein said elastically elongatable base fabric is nylon or polyester with a percentage of elastic fibers oriented in said first direction; those wherein said at least one additional elastically elongatable layer laminated to the base fabric is a cushioning material; and those wherein said eye tape and said hook tape are attached to corresponding girth portions of a brassiere.

Another embodiment is drawn to a method of allowing dynamic girth adjustment of a garment, comprising providing the hook and eye closure of the previous embodiment to corresponding girth portions of said garment, and securing said garment to a wearer using said hook and eye closure. A variation on this method includes further comprising providing said hook and eye closure to corresponding girth portions of a brassiere.

Yet another embodiment is drawn to a method of forming a stretchable hook and eye closure for a garment, comprising: forming an eye tape, said forming comprising: providing a base fabric that elongates elastically, laminating at least one additional elastically elongatable layer to the base fabric to form an elastically elongatable base tape, securing at least one eye column on said elastically elongatable base tape by securing at least on eye to said base fabric to form at least one eye row in said at least one eye column; and forming a hook tape, said forming a hook tape comprising: providing a hook base fabric, and positioning one hook column in said second direction on said hook base fabric by securing at least one hook to form at least one hook row in said at least one hook column.

Variations on this method include: those further comprising: positioning a plurality of parallel eye columns spaced apart from each other in a first direction, positioning a plurality of eye rows in each eye column spaced apart from each other in a second direction perpendicular to the first direction, and securing a plurality of hook rows in said one hook column spaced apart from each other in said second direction and corresponding in number to said plurality of eye rows; those wherein providing said hook base fabric comprises: providing a base fabric that elongates elastically, and laminating at least one additional elastically elongatable layer to the base fabric to form an elastically elongatable base tape; those wherein said closure allows between about 10% and about 100% elongation; those wherein said closure allows between about 20% and about 30% elongation; those wherein said base fabric is nylon or polyester with a percentage of elastic fibers; those wherein said eye tape and said hook tape are attached to corresponding girth portions of a brassiere; those wherein said at least one additional elastically elongatable layer is formed of cushioning material; and those wherein said at least one additional elastically elongatable layer further comprises an elastically elongatable fabric layer laminated to the cushioning material.

Although described herein with reference to particular embodiments, one of ordinary skill in the art will recognize that numerous additional embodiments are possible and that various modifications can be made without departing from the scope of the present invention, which is limited only by the claims below. For example, the number of eyes/hooks per column, the number of eye columns, the eye spacing, the column spacing, the materials used, the fabric layering arrangements, the sewing or other fastening used, the type of garment, the orientation of the hooks/eyes with respect to the garment, the base tape shapes, etc. can all be varied for particular applications without departing from the scope of the invention. Similarly, one of skill in the art would recognize the utility of practicing the invention with similar fasteners, such as used on snap tapes of teddys. Further, any reference to claim elements in the singular, for example, using the articles "a," "an," or "the" is not to be construed as limiting the element to the singular.

What is claimed is:

1. A base tape for a hook and eye closure to allow dynamic girth adjustment of a garment, comprising:

a first elastically elongatable fabric layer;

at least one additional elastically elongatable layer laminated with adhesive to an entire surface of a first side of the first elastically elongatable fabric layer to form an elastically elongatable base tape; and hook or eye closure hardware sewn to the elastically elongatable base tape.

2. The base tape of claim 1, wherein the at least one additional elastically elongatable layer comprises a second elastically elongatable layer consisting of cushioning material and a third elastically elongatable layer consisting of fabric that is laminated to the second elastically elongatable layer.

3. The base tape of claim 2, wherein the cushioning material is selected from the group consisting of fabric, stretchable foam, flex foam, and rubber.

4. The base tape of claim 1, wherein the closure hardware consists of a plurality of spaced eyes.

5. The base tape of claim 1, further comprising an elastically elongatable cover strip fabric attached to the elastically elongatable base tape to conceal attachment points of the closure hardware.

6. The base tape of claim 1, wherein the garment consists of a brassiere.

7. A hook and eye closure for allowing dynamic girth adjustment of a garment, comprising:

an eye tape, said eye tape comprising:

an elastically elongatable base fabric that elongates elastically in a first direction;

at least one additional elastically elongatable layer laminated with adhesive to an entire surface of a first side of the base fabric to form a laminated base tape;

at least one eye column positioned on said laminated base tape wherein said at least one eye column extends in a second direction perpendicular to the first direction; and at least one eye row in said at least one eye column, each row containing an eye secured to said laminated base tape; and a hook tape, said hook tape comprising:

a hook base tape;

one hook column positioned on said hook base tape in said second direction; and at least one hook row in said at least one hook column, each row containing a hook secured to said hook base tape.

8. The apparatus of claim 7, further comprising:

a plurality of parallel eye columns spaced apart from each other in said first direction;

a plurality of eye rows in each eye column spaced apart from each other in said second direction; and a plurality of hook rows in said one hook column spaced apart from each other in said second direction and corresponding in number to said plurality of eye rows.

9. The apparatus of claim 7, wherein said hook base tape is stabilized.

10. The apparatus of claim 7, wherein said closure allows between about 10% and about 100% elongation.

11. The apparatus of claim 7, wherein said closure allows between about 20% and about 30% elongation.

12. The apparatus of claim 7, wherein said at least one additional elastically elongatable layer laminated to the base fabric is a cushioning material.

13. The apparatus of claim 7, wherein said eye tape and said hook tape are dimensioned to be attached to corresponding girth portions of a brassiere.

14. A method of forming a stretchable hook and eye closure for a garment, comprising:

forming an eye tape, said forming comprising:

providing a base fabric that elongates elastically;

adhesively laminating at least one additional elastically elongatable layer to an entire surface of a first side of the base fabric to form an elastically elongatable base tape;

securing at least one eye column on said elastically elongatable base tape by securing at least on eye to said base fabric to form at least one eye row in said at least one eye column; and forming a hook tape, said forming a hook tape comprising:

providing a hook base fabric; and positioning one hook column in said second direction on said hook base fabric by securing at least one hook to form at least one hook row in said at least one hook column.

15. The method of claim 14, further comprising:

positioning a plurality of parallel eye columns spaced apart from each other in a first direction;

positioning a plurality of eye rows in each eye column spaced apart from each other in a second direction perpendicular to the first direction; and securing a plurality of hook rows in said one hook column spaced apart from each other in said second direction and corresponding in number to said plurality of eye rows.

16. The method of claim 14, wherein said closure allows between about 10% and about 100% elongation.

17. The method of claim 14, wherein said closure allows between about 20% and about 30% elongation.

18. The method of claim 15, wherein said eye tape and said hook tape are attached to corresponding girth portions of a brassiere.

19. The method of claim 14, wherein said at least one additional elastically elongatable layer is formed of cushioning material.

20. The method of claim 19, wherein said at least one additional elastically elongatable layer further comprises an elastically elongatable fabric layer laminated to the cushioning material.

21. The apparatus of claim 7 in combination with a brassiere, wherein said eye tape and said hook tape are attached to corresponding girth portions of the brassiere.

22. A base tape for a hook and eye closure to allow dynamic girth adjustment of a garment, comprising:

a first elastically elongatable fabric layer;

an elastically elongatable layer of cushioning material laminated to the first elastically elongatable fabric layer with adhesive to an entire surface of a first side of the elastically elongatable layer of cushioning material;

a second elastically elongatable fabric layer laminated with adhesive to an entire surface of a second side of the elastically elongatable layer of cushioning material to form an elastically elongatable base tape; and hook or eye closure hardware sewn to the elastically elongatable base tape.

23. The base tape for a hook and eye closure of claim 22, wherein the first elastically elongatable fabric layer, the elastically elongatable layer of cushioning material, and the second elastically elongatable fabric layer are elongatable in an omni-directional manner.

24. The base tape for a hook and eye closure of claim 23, wherein edges of the base tape are formed by being ultrasonically cut and sealed.

* * * * *